United States Patent [19]

Williams

[11] Patent Number: 4,525,951

[45] Date of Patent: Jul. 2, 1985

[54] BARRIER UNLOCKING MECHANISM

[75] Inventor: Joseph E. Williams, Shankill, Ireland

[73] Assignee: Coras Iompair Eireann, Dublin, Ireland

[21] Appl. No.: 472,031

[22] Filed: Mar. 4, 1983

[30] Foreign Application Priority Data

Mar. 5, 1982 [IE] Ireland ..... 496/82

[51] Int. Cl.[3] ..... E06B 11/08

[52] U.S. Cl. ..... 49/47; 49/35

[58] Field of Search ..... 49/46, 47, 35

[56] References Cited

U.S. PATENT DOCUMENTS

| | | | |
|---|---|---|---|
| 3,559,341 | 2/1971 | Alvarado | 49/47 |
| 3,771,262 | 11/1973 | Gaulier | 49/46 X |
| 3,795,075 | 3/1974 | Orzechowski . | |
| 3,978,613 | 9/1976 | Hayward et al. . | |

FOREIGN PATENT DOCUMENTS

| | | |
|---|---|---|
| 7807069 | 4/1980 | Brazil . |
| 1949074 | 6/1970 | Fed. Rep. of Germany . |
| 2736015 | 7/1978 | Fed. Rep. of Germany . |
| 2746896 | 4/1979 | Fed. Rep. of Germany . |
| 2353909 | 12/1977 | France . |
| 772551 | 6/1978 | South Africa . |
| 1461078 | 1/1977 | United Kingdom . |
| 2000831 | 1/1979 | United Kingdom . |
| 2018350 | 10/1979 | United Kingdom . |
| 2046973 | 11/1980 | United Kingdom . |
| 1600034 | 10/1981 | United Kingdom . |

*Primary Examiner*—Kenneth Downey

*Attorney, Agent, or Firm*—Schwartz, Jeffery, Schwaab, Mack, Blumenthal & Evans

[57] ABSTRACT

A locking and releasing mechanism for a turnstile has a locking member which abuts a stop roller mounted on the hub of the turnstile at a spacing from its axis, to prevent rotation. A sleeve portion of the locking member is axially slidable in a cylinder and a plurality of balls retained in circumferentially disposed holes in the sleeve wall latch the member in its locking position by engaging in angled recesses in the cylinder wall. A latch release piston axially movable within the sleeve by an air motor has a peripheral groove and the locking member is unlatched by aligning the groove with the sleeve holes so that the balls disengage from the recesses and engage in the groove. The balls are urged towards the groove by springs and where present by axial loading of the locking member resulting from attempted rotation of the turnstile.

18 Claims, 10 Drawing Figures

BARRIER UNLOCKING MECHANISM

BACKGROUND OF THE INVENTION

1. Field of the Invention

This invention relates to a locking and release mechanism for a barrier, such as a barrier for a gate for controlling passenger access to a railway or rapid transit station or a public transport vehicle. In particular the invention relates to a locking and release mechanism for a gate having at least one stop member associated with the barrier and a locking member displaceable between a locking position in which it engages the stop member to prevent displacement of the barrier and a release position in which the barrier may be displaced.

The invention relates to a locking and release mechanism for a gate having means defining a passage for movement through the gate and at least one barrier means which is disposed in a blocking position at least when the gate is in a locked condition and is displaceable at least from its blocking position to a clear position when the gate is in a free condition, movement through the passage being substantially inhibited when the gate is in its locked condition and being substantially unhindered by the barrier means when the gate is in its free condition, at least during displacement of the barrier means from its blocking position to said clear position.

The locking and release mechanism may comprise at least one locking member movable between a locking position and a release position and at least one stop member displaceable between a rest position and a free position along at least one path, displacement of the stop member from its rest position at least along said path being prevented when the locking member is in its locking position and the stop member being displaceable at least along said path at least when the locking member is in its release position. The stop member of the locking and release mechanism may be associated with the barrier means of the gate so that the stop member is disposed in its rest position when the barrier means is disposed in its blocking position and the stop member is disposed in a free position when the barrier means is disposed in a clear position. Such gates and locking mechanisms are known and used, in particular in ticket barriers for controlling passenger access to railway and rapid transit stations.

2. Description of the Prior Art

A well-known and widely-used gate of the type described is the tripod turnstile, and embodiments of the locking and release mechanism according to the invention disclosed herein will be described in relation to a tripod turnstile.

A brief description of the general construction and functioning of a ticket barrier embodying a tripod turnstile gate follows but the mechanism according to the invention is not limited to such gates or barriers, and may also be applied to, inter alia, "paddle" type gates. The ticket barrier includes a structure defining a passage through which passengers can move and barrier means formed by the arms of the tripod turnstile. The turnstile is rotatably mounted so that one arm of the tripod is disposed in a blocking position which is usually substantially horizontal when the gate is in a locked condition so as to substantially inhibit the movement of passengers through the gate. When the gate is in its free condition, a passenger may rotate the tripod turnstile by manual action or body pressure, so that the initially horizontal arm of the turnstile which inhibited his passage through the gate in the locked condition is displaced, initially forwardly away from him and then downwardly to a clear position, while the passenger moves past it during this displacement and on out of the gate. At the same time the following arm of the tripod is moved upwardly and latterly forwardly behind the passenger and reaches its horizontally disposed, blocking position when the first-mentioned arm reaches its clear position. In normal use, the barrier then again reverts to a locked condition by the action of automatic control means and is unlocked by the presentation of a valid ticket to a ticket checking or validation device. Each time the gate is unlocked, an arm of the tripod can be displaced from its blocking position to a clear position and a single passenger can pass through.

Barriers of this type may also be operated under the supervision of an operative, as well as in conjunction with automatic ticket validators and the like. It is usually a requirement of gates of this type that the turnstile should be able to run free in conditions of power failure or emergency, as opposed to its normal mode of operation in which just one passenger is permitted to move through the gate each time the gate is unlocked. In the normal mode, the gate cannot be passed through in the absence of a valid ticket, without climbing over it or ducking under the barrier means, in the case of a tripod turnstile.

British Patent Specification No. 1,461,078 discloses a turnstile control mechanism comprising a shaft for connection to a stile or barrier, the shaft being mounted rotatably in a support structure, a detent mounted on the support structure for movement to a position in which it holds the shaft in a predetermined angular position, a pneumatic ram provided on the support structure for loading the detent into its shaft holding position and a valve associated with the ram and operable to release pneumatic pressure in the ram to thereby unload the detent and permit shaft rotation.

The pneumatic pressure can be set to a value such that the detent loading afforded thereby can be overcome to allow turnstile operation even without valve release of the pressure, albeit by exerting more than normal pressure on the barrier, so that if the barrier is used to control exit from a public place then in the event of, for example, fire and panic conditions, the barrier does not prevent exit even though a normal detent release is not effected.

Further desirable features to be sought in gates of this type are a facility for bi-directional operation so that the gate can cope with passenger flows in either direction and thereby reduce the number of gates to be installed at any given station, and a non-return arrangement, so that the barrier, when unlocked, can only be operated for movement through it in a direction appropriate to the ticket presented.

South African Patent Specification No 77/2551 discloses a control divide for a turnstile which comprises a rotatable member, a plurality of formations on the member first locking means which is engageable with at least one of the formations to prevent rotation of the member in the first direction but which permits rotation of the member in a second direction opposite to the first direction, a second locking means which is engageable with at least one of the formations to prevent rotation of the member in the second direction but which permits rotation of the member in the first direction, and means to disengage either the first or the second locking means from each formation to permit rotation of the member in the first direction, or in the second direction respectively.

BRIEF SUMMARY OF THE INVENTION

1. Object of the Invention.

These various desirable attributes are related to the properties of the locking and release mechanism, and it is an object of the invention to provide a locking and release mechanism, which when applied to a gate, will result in the gate having one or more of the above advantages. It is a further object of the invention to provide a locking and release mechanism having the ability to unlock the barrier means so that a passenger can pass through the gate while the passenger is leaning on the barrier means or otherwise exerting pressure against it. It is also an object of the invention to provide a mechanism which may remain in operation for at least a limited period in conditions of failure of the mains electrical supply.

2. Features of the Invention.

According to the first aspect of the invention, there is provided a locking and release mechanism for a barrier of a gate having at least one stop member associated with the barrier said mechanism comprising:

(a) a body portion of the mechanism having a fixed latch-abutment portion, (b) a locking member having a movable latch-abutment portion and being displaceable relative to said body portion between a locking position in which the locking member engages the stop member to prevent displacement of the barrier and a release position in which the barrier may be displaced, (c) latch means for retaining the locking member in its locking position the latch means having a latch member displaceable between a latching position in which it engages between said fixed and movable latch-abutment portions and an unlatched position in which it is disengaged from said fixed abutment portion, said abutment portions being disposed relative to the latch member in its latching position so that when the locking member is in its locking position and a force is applied to it urging it towards its release position, said abutment portions apply forces to the latch member urging it towards its unlatched position, and (d) latch holding and release means having a latch release member displaceable between a latch retaining position in which it maintains the latch member in its latching position and a releasing position in which the latch member may be displaced from its latching position towards its unlatched position.

Preferably the latch release member has a surface portion for maintaining the latch member in its latching position and a portion which is recessed relative to said surface portion, for receiving the latch member in its unlatched position and the recessed portion has a cam surface for displacing the latch member from its unlatched position towards its latching position when the latch release member is moved from its releasing position towards its retaining position.

Suitably the latch member in its unlatched position couples the locking member and latch release member for displacement together and the locking member has a coupling abutment portion and the latch release member has a coupling abutment surface, the latch release member is further displaceable between its releasing position and an end position, and the latch member engages between the latch-abutment and coupling abutment portions of the locking member and between the cam surface and coupling abutment surface of the latch release member in the released condition of the latch means and is retained therebetween during movement of the latch release member between its releasing position and its end position.

In a preferred embodiment, the latch-abutment portions each comprise a surface which contacts the latch member, at least when the latch member is in its latching position and when a force is applied to the locking member to urge it towards its release position, and the latch member is of circular cross-section, its periphery being tangent to said surfaces and said surfaces being non-parallel, at least in those regions tangent to the latch member.

In a particularly preferred embodiment, (a) said body portion of the mechanism has a cylinder, said cylinder having a plurality of substantially cylindrical recesses in the cylinder wall, the axis of each recess being disposed at an acute angle relative to the cylinder axis, and the body portion has a plurality of said fixed latch-abutment portions, each defined by a wall portion of a said recess, (b) said locking member is a sleeve-form outer piston, which is axially displaceable within said cylinder and has a plurality of circumferentially spaced skewed conical holes therein corresponding in number to the number of said recesses, and the locking member has a plurality of said latch-abutment portions and said coupling abutment portions defined by respective opposed wall portions of said holes, (c) said latch means has a plurality of latch members, each of which is a ball, and springs are provided in said recesses in the cylinder wall for urging the balls outwardly thereof when in their latching positions, (d) said latch release member is an inner piston which is axially displaceable within said sleeve-form outer piston between its retaining and end positions and is coupled to said outer piston during movement between its releasing and end positions, said recessed portion is an annular groove and said cam surface and coupling abutment surface are defined by side walls of said groove, and (e) the latch holding and release means comprises means for driving the latch release member between its retaining and releasing position and for driving it between its releasing position and its end position to move the locking member between its locking and release positions.

Suitably the driving means is an air motor having a diaphragm and a spring for urging the inner piston from its releasing position towards its end position, the diaphragm being displaceable by air pressure to move the inner piston from its end position towards its releasing position against the force of the spring.

According to a second aspect of the invention, there is provided locking and release mechanism for a barrier of a gate a gate having at least one stop member associated with the barrier, said mechanism comprising:

(a) a body portion of the mechanism having a cylinder, said cylinder having a plurality of substantially cylindrical recesses in the cylinder wall, the axis of each recess being disposed at an acute angle relative to the cylinder axis, and a wall portion of each said recess defining a fixed latch-abutment portion, (b) an outer sleeve-form locking piston, which is axially displaceable within said cylinder between a locking position in which said piston engages the stop member to prevent displacement of the barrier and a release position in which the barrier may be displaced, the piston having a plurality of circumferentially spaced skewed conical holes therein corresponding in number to the number of said recesses, (c) a plurality of latching balls, displaceable between latching positions in which they engage between wall portions of said outer piston holes and said fixed latch-abutment portions and unlatched positions in which they are disengaged from said fixed latch-abutment portions, springs being provided in said recesses for urging the balls outwardly thereof when in their latching positions, (d) an inner latch release piston which is axially displaceable within said outer piston between a latch retaining position and a releasing position and between said releasing position and an end position, said release piston having a surface portion for maintaining the balls in their latching positions when the piston is in its retaining position and an annular groove for receiving the balls in their unlatched positions, the latching balls being accommodated partially in said outer piston holes and partially in said inner piston annular groove during movement of the inner piston between its releasing and end positions to couple the pistons together, and a side wall of said groove defining a cam surface for displacing the latching balls from their unlatched positions to their latching positions during movement of the inner piston from its releasing position to its latching position, and (e) means for driving the inner piston between its retaining and releasing position and between its releasing and end positions.

According to a further aspect of the invention, there is provided a gate having at least one barrier, a stop member associated with the or each barrier and at least one locking mechanism according to the first aspect of the invention.

The gate according may have a plurality of barriers, each consisting of an arm of a turnstile of the tripod type, in which three arms extend from a rotatably mounted boss, the boss being mounted so that one arm is substantially horizontally disposed in a blocking position at least when the gate is in a locked condition and each of the other arms is then disposed in a clear position, the locking member then abutting the stop member associated with the substantially horizontally disposed arm and being moved to its release position to permit rotation of the turnstile and displacement of the initially substantially horizontal arm to one of said clear positions.

Suitably the gate has a rotatable ratchet member forming part of or operatively associated with the turnstile and a spring-loaded pawl member, the rotatable member being provided with a series of spaced apart teeth disposed along a circular path about the axis of rotation of the rotatable member, said series having three spaced apart interruptions and said pawl member being disposed in a said interruption in the series of teeth when the barrier is in its blocking position.

In a particular construction the gate has two locking and release mechanisms, each locking member abutting an opposite side of the stop member in the locked condition of the gate, and the other of said locking members being displaceable during a said rotation of the turnstile to permit displacement of the arm initially disposed in the other of said clear positions into a substantially horizontal disposition in which said arm is disposed in a blocking position.

Preferably the ratchet member is bi-directional for preventing reverse displacement of the barrier during displacement thereof from its blocking position to a clear position, at least until it reaches said clear position and the gate has switch means for reversing the movement of the first-mentioned locking member so that it moves from its release position to its locking position during a said rotation to prevent displacement of the arm undergoing displacement towards said blocking position of the barrier beyond said blocking position by abutment of the stop member associated with said arm against said locking member.

According to another aspect of the invention there is provided a locking and release mechanism comprising at least one locking member movable between a locking position and a release position and at least one stop member displaceable between a rest position and a free position along at least one path, displacement of the stop member from its rest position at least along said path being prevented when the locking member is in its locking position, the stop member being displaceable at least along said path at least when the locking member is in its release position and movement of the locking member from its locking position towards its release position permitting displacement of the stop member from its rest position towards said free position along said path, releasable latch means for retaining the locking member in its locking position having at least one latch member displaceable between a latching position and an unlatched position, and latch holding and release means for maintaining the latch member in its latching position and operable to release said latch means and permit displacement of the latch member from its latching position towards its unlatched position, the locking member being movable between its locking position and its release position when the latch means is in a released condition, the latch member being interposed between an abutment portion of the locking member and a fixed abutment of the mechanism when in its latching position to prevent movement of the locking member from its locking position towards its release position, and said abutment portion and fixed abutment being disposed relative to the latch member in its latching position so that when the locking member is in its locking position and a force is applied to it urging the locking member towards its release position said abutment portion and fixed abutment apply forces to the latch member urging it towards its unlatched position, the latch member being maintained in its latching position by said latch holding and release means until the latch holding and release means is operated to release the latch means.

The locking and release mechanism according to the invention is not restricted to use in gates consisting of ticket barriers of the tripod type only, but it may also be applied to barriers having turnstiles of the paddle type or gates in which the barrier means is non-rotary in its movement. It will also be appreciated that the invention may be employed in gates of similar general type for the control of pedestrian movement in circumstances other than those applying in railway stations, and that the invention may in certain situations also be applied to gates controlling vehicular or animal movement, where the particular advantages resulting from it may be found to be beneficial. The locking and release mechanism according to the invention may also be applied in apparatus other than gates, and in general, in any apparatus where reliable release of a latched member subject to loading is required.

BRIEF DESCRIPTION OF THE DRAWINGS

Some embodiments of the invention will now be described in more detail with reference to the accompanying drawings, in which.

DETAILED DESCRIPTION OF THE INVENTION

Figure 1:
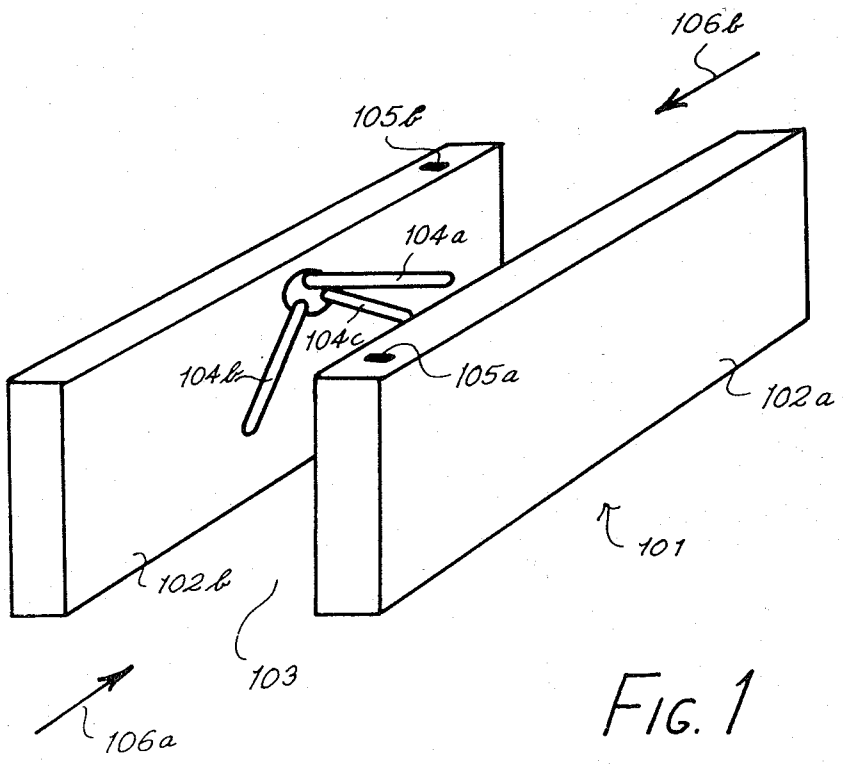
FIG. 1 is a pictorial view of a tripod turnstile gate.

As shown in FIG. 1, a tripod turnstile gate 101 has a structure 102*a* and 102*b* defining a passage through which passengers or other users can pass. The tripod arms 104*a*, 104*b* and 104*c* form a displaceable barrier in the passage 103. The turnstile is rotatably mounted and as shown in the drawing, the arm 104*a* is disposed in a substantially horizontal blocking position in the passage 103. In the locked condition of the gate, locking means associated with the turnstile and housed within the structure portion 102*b* are arranged to maintain the tripod turnstile in a blocking condition with arm 104*a* of the tripod in the blocking position, so as to substantially inhibit pedestrian movement of passengers through the passage 103, while the other two arms 104*b* and 104*c* will then be downwardly directed and disposed in respective clear positions in which they do not seriously interfere with access to the passage from either side of the gate. The gate includes ticket (or other authorisation) validation means within the structure 102*a* and/or 102*b*, into which tickets or the like may be inserted through slots 105*a* or 105*b* in the upper surface of these structure portions. Activation of the locking means associated with the turnstile by insertion of a valid ticket or other permit unlocks the tripod turnstile and allows it to be rotated by manual action or body pressure. Accordingly when a person wishes to pass through the gate in the direction of arrow 106*a*, and it is in its unlocked or free condition, he pushes against the horizontally disposed arm 104*a*, so that it moves forwardly and downwardly to the clear position initially occupied by arm 104*c*, while arm 104*b* moves upwardly and forwardly from a clear position to the blocking position initially occupied by arm 104*a*, so as to take up a horizontal disposition and again block the passage. During this part rotation, while an arm of the turnstile is undergoing displacement from a blocking position to a clear position, a single passenger may pass through the gate, and when the arm 104*b* reaches the horizontal blocking position, the gate is again locked so that the turnstile cannot be rotated further. The gate shown is bi-directional and passengers may pass through either in the direction of arrow 106*a* or that of arrow 106*b*.

Figure 2:
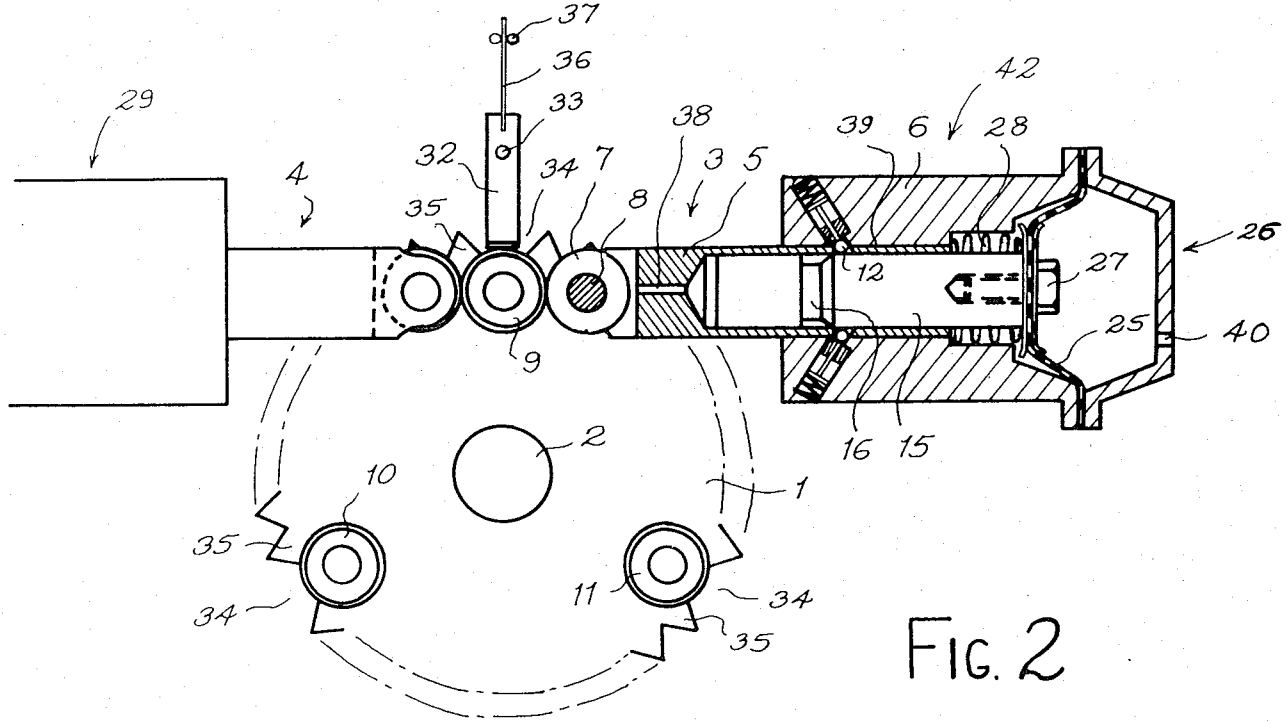
FIG. 2 shows in part-sectional elevation a tripod turnstile boss and two locking mechanisms according to the invention, one of the mechanisms being in section.

Referring now to FIG. 2, a boss or base portion 1 of a tripod turnstile, the arms of which constitute the barriers in a gate of the type shown in FIG. 1, is rotatably mounted on a shaft 2. Two locking and release mechanisms, 29 and 42 respectively, are associated with the turnstile. The mechanisms 29 and 42 have respective locking members 4 and 3. Release of locking member 3 permits clockwise rotation (with reference to FIG. 2) of the turnstile while release of member 4 permits anti-clockwise rotation. Each locking member consists of an outer piston 5, (as shown in section for member 3), part of which is in the form of a sleeve. The piston 5 is mounted for sliding movement in its axial direction in a cylinder 39, formed by a bore in a housing member or body portion 6 of the mechanism. The leading end of the locking member carries a roller 7 rotatably mounted on a shaft 8 for abutting engagement with a stop 9 on the boss 1 of the tripod turnstile when the locking member is in a locking position. When the roller 7 abuts the stop 9, and the gate is in a locked condition, the stop 9 is retained in a rest position and rotation of the tripod turnstile in a clockwise direction is prevented. Rotation of the turnstile in the anti-clockwise direction is similarly prevented in the locked condition of the gate by the locking member 4, on the opposite side of the stop 9 from that occupied by member 3 in its locking position. The tripod boss 1 has three stops 9, 10 and 11, each of which is associated with a respective tripod arm and occupies said rest position when the associated arm of the tripod turnstile is disposed in its blocking position, and occupies a free position when the associated arm is in a clear position.

Figure 3:
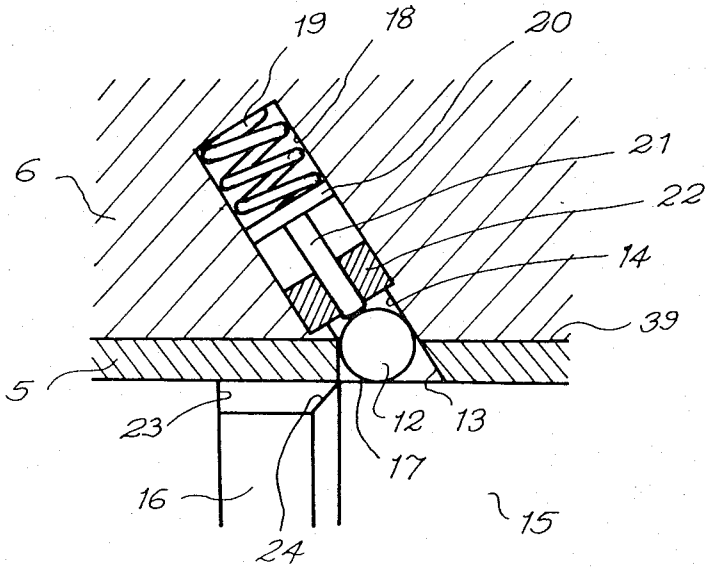
FIG. 3 is a detail view of latch means for the locking member of the locking mechanism of FIG. 2.

Means are provided for latching the member 3 in its locking position and consist of a series of balls 12, arranged in a spaced circumferential array around the sleeve portion of piston 5. As shown in greater detail in FIG. 3, the sleeve portion has a series of circumferentially spaced holes 13, each of which partially accommodates one of the balls 12 when the ball is in a latching position. The rest of the ball is then accommodated within a recess 14 in the cylinder wall of the opening 39 in the housing 6, with which the sleeve portion of piston 5 is in slidable contact. A circumferentially spaced array of these recesses 14 is also provided, and the number of holes 13 and recesses 14 corresponds to the number of balls 12. A bush 22 prevents the entire ball from entering the recess 14.

The walls of the holes 13 in the sleeve each define portions of a skewed cone, the wall portion of which on the side nearest the leading end, i.e. the end carrying roller 7, of the locking member is disposed substantially perpendicular to the sleeve axis. The recesses 14 are each cylindrical and their axes are disposed at an inclination to the axis of the sleeve. The angle of inclination of the axis of the recess is substantially the same as the inclination, with respect to the sleeve axis, of the wall portion of the skewed conical hole 13 which is distant from the leading end of the locking member.

Latch holding and release means for control and resetting of the latch means include a latch release member consisting of a shaft or inner piston 15 which is axially slidable within the sleeve portion of outer piston 5 and can be moved independently of the sleeve portion within certain limits when this latter is latched in the locking position. The leading end region of the outer piston is provided with a hole 38 for relieving any pressure build-up of lubricant caused by the piston-type action of the shaft 15 over part of its movement. The shaft 15 is provided with an annular or circumferential groove 16, and in the locked condition of the gate, the shaft is positioned relative to the sleeve so that a portion 17 of the external surface of the shaft adjacent to the groove 16 bears against the balls 12 to hold them within the holes 13 and recesses 14. Thus the barrier means cannot be moved since any pressure or force against an arm of the tripod causes the balls 12 to contact or bear against the sides of the holes and recesses, portions of the walls of which thus serve as abutments or abutment surfaces, while radially inward movement of the balls is prevented by the presence, in a retaining position, of the shaft 15.

The locking member 3 is unlatched by moving the shaft 15 axially relative to the sleeve until the groove 16 comes into alignment with the balls 12, the latch release shaft 15 being then disposed in a releasing position. The balls then move inwardly into the groove, and take up unlatched positions in which they are partially accommodated in the groove 16 and partially accommodated in the holes 13 in the sleeve portion of piston 5. In this way the piston 5 is unlatched relative to the housing, and the shaft and piston subsequently move or are moved axially as a unit to a release position of the locking member, the balls 12 being retained between abutment surfaces of the holes 13 and the groove 16 in the released condition of the latch means. The shaft 15 can either be retracted axially under power to move the piston 5 away from the stop 9, or alternatively the shaft and piston 5 can be moved back axially by displacement of the stop itself. The stop is displaced by pressure against the arm of the turnstile, the gate then being in the free condition.

Accordingly the latch release member or inner piston 15 maintains the latching balls 12 in their latching positions when it is in its retaining position and controls displacement of the balls into their unlatched positions. It also resets the latch means by displacing the balls from their unlatched positions into their latching positions during movement of the piston from its releasing position to its retaining position. When the balls are in their unlatched positions, they couple the inner and outer pistons together and the two pistons may then be moved together towards the release position of the outer or locking piston 5 by user movement of the turnstile arm urging the stop roller 9 against the locking piston. Alternatively inner piston 5 may be driven between its releasing position and an end position to move the locking piston between its locking and release positions.

Figure 4:
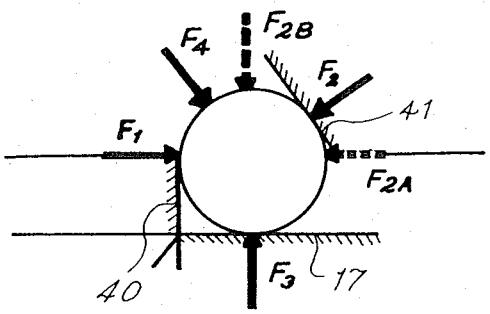
FIG. 4 is a diagram of the force system acting on a ball of the latch means of FIG. 3 when a force is applied to an arm of the tripod barrier.

FIG. 4 shows in schematic form, the forces acting on the balls 12 when these are in their latching positions and pressure is at the same time exerted against that arm of the turnstile which is in the blocking position. This pressure is applied to the ball by force $F_1$, which is exerted by the perpendicular abutment surface 40 of the hole 13 in the sleeve portion of piston 5 and is resisted by the force $F_2$ between the inclined abutment surface 41 of the recesss 14 and the ball. The force $F_2$ is not directly in line with $F_1$ due to the inclination of the wall of the recess 14, and thus it has a first component $F_{2A}$ which opposes the pressure force $F_1$ and a second component $F_{2B}$ at right angles to $F_{2A}$ which acts on the ball 12 in a direction radial of shaft 15 and is opposed by a reaction force $F_3$ exerted on the ball by the surface 17 of the shaft 15. Thus when a user is pressing against the barrier and the shaft 15 is moved to align the groove 16 with the balls 12, the force $F_3$ is removed and the component $F_{2B}$ of force $F_2$ urges the balls radially inwardly of the shaft into their unlatched positions.

The locking member 3 can therefore be unlatched even when a force or pressure is applied to the turnstile by a user leaning against it, and unlatching is actually assisted by such pressure or force.

This force component $F_{2B}$ will not be present in the absence of pressure or force on the turnstile, and to ensure the inward movement of the balls in this circumstance also, so as to unlock the gate, the mechanism also includes means for urging the balls 12 out of the recesses 14 and into the groove 16 when the groove is aligned with the holes 13 in the sleeve portion of piston 5. This means is housed within a rear portion 18 of the recess 14, and consists of a spring 19, one end of which abuts the rear surface of the recess portion 18 and the other end of which bears against a plate 20 affixed to one end of a spindle 21. The spindle 21 is slidably mounted in the bush 22 fixedly retained within the recess 14, and is thus guided by the bush for axial movement. The bushes 22 also act as stops for the balls 12 in the recesses 14, to prevent them from moving into the recesses beyond their latching positions. When the balls 12 are in their latching positions, the springs 19 are compressed. When the groove 16 comes into alignment with the holes 13, the springs propel the plates 20 along the recesses so that the spindles 22 push the balls out of the recesses into the groove. The force exerted by the spring 19 on the ball 12 is indicated in FIG. 4 by $F_4$.

The angle of inclination of the recesses 14 to the sleeve axis must be acute with respect to the leading or roller end of the locking member 3, so that an inward force tending to urge the balls from their latching positions, into their unlatched positions is applied to the balls when a turning force or pressure is exerted on the turnstile. The angle of inclination of the recesses 14 is not critical and may vary between 5° and 75°, in particular between 15° and 45°. Suitable angles of inclination are $22\frac{1}{2}$° or 30°. In a construction in which the central shaft 15 is fixed and the latch release means consists of a movable annular cylinder wall portion surrounding the sleeve in the region of the holes 13, the balls are accommodated in part in recesses in the shaft when in their latching positions. In this instance the unlatched positions of the balls are outwards from the shaft 15 and the balls are urged outwardly towards their unlatched positions by the pressure force exerted by a person pressing against the turnstile arm in the blocking position.

When the balls are in their unlatched positions, the shaft and sleeve move or are moved axially together and the balls are prevented from moving out of their positions of engagement in groove 16 and holes 13 by the wall of the cylindrical opening 39 in the housing in which the sleeve portion of piston 5 is slidable, which is substantially continuous and unbroken save for the recesses 14. Thus once the balls are moved away from these recesses, they cannot escape from their positions in the groove and holes, and they serve to couple the shaft and sleeve portion to one another. The springs 19 acting on the spindles 21 help to prevent the balls from moving back into the recesses as the shaft and sleeve portion move relative to the recesses, and the groove 16 has a radially disposed annular abutment surface 23 on the axially leading side of the groove, i.e. the side nearest the roller 7, which avoids any outwardly directed force being applied to the balls during this movement of the holes in the sleeve portion away from the recesses 14. Thus the balls, once accommodated partially in the groove 16, are not forced back outwardly into the recesses as the shaft and sleeve portion move or are moved in unison axially away from the locking position of the piston 5. Axial movement of the shaft 15 continues to an end position thereof in which the locking member piston 5 is in the release position.

Uncoupling of the shaft and sleeve from each other during return axial movement of these members is provided for by an inclined annular cam surface 24 on the trailing side of the groove 16 from the radially extending surface 23, which forces the balls outwardly of the groove during return axial movement of the shaft and sleeve towards the locking position of the sleeve. When the sleeve reaches its locking position, the balls 12 are forced out of the groove and back into their latching positions, in which they are received in part in the recesses 14 and in part in the holes 13, by the cam surface 24 acting against the force of the springs 19 to urge the balls outwardly of the groove, the bushes 22 preventing them from entering wholly into the recesses 14. Further return movement of the locking member is prevented by latching engagement of the balls 12.

In an alternative arrangement, the balls in their unlatched positions may be accommodated in appropriately disposed recesses in the inner piston 15, entirely clear of the sleeve, so that the inner piston and sleeve are not coupled together for further movement following unlatching of the locking member. Further movement of the locking member sleeve may then take place by pressure against the turnstile barrier, the member being returned to its locking position by spring pressure.

In all constructions, the sleeve is restrained against rotation relative to the housing of the mechanism to maintain the holes and recesses in registration with each other. The latch members may however be of a form other than balls 12, e.g. they may in some circumstances be rollers of suitable profile.

In the arrangement shown in FIG. 2, the shaft 15 is driven axially by an air motor 26. The rear end of the shaft 15 (i.e. remote from the roller 7) is secured to the diaphragm 25 of the air motor 26 by a bolt 27. When air pressure is applied to the diaphragm through the aperture 40 in the cover of the diaphragm motor, the shaft is moved axially to the left in FIG. 2, i.e. towards the locking position of the sleeve, and it is retained in this position as long as the air pressure is maintained. The balls 12 are held in their latching positions by the surface 17 and the gate is in a locked condition. The mechanism also includes a spring 28 which acts against the air pressure, and when the air pressure is relieved, the spring force moves the diaphragm to the right, so that the shaft 15 is also moved to the right, i.e. away from the locking position of the sleeve, thus releasing the latch means by allowing the balls to move into the groove 16 during the initial part of the shaft movement. The sleeve is then coupled to the shaft during the remaining part of the axial movement of the shaft, which is terminated when the diaphragm reaches the limit of its travel. Thus the locking member is moved axially away from the stop 9 and the turnstile can be rotated in a clockwise direction. While spring drive of the shaft 15 towards the release position of the locking member is preferred, the spring may be air pressure assisted, or the shaft may be wholly air-driven in this direction also.

Release of air pressure to withdraw locking member 3 and permit clockwise rotation of the turnstile takes place on insertion of a valid ticket or other token in the appropriate place in the gate. The systems involved may include, for example, ticket reading devices and one or more pneumatic valves controlling air supply to the air motor. Locking member 4 must also be withdrawn to allow stop 10 to move upwards and into the position initially occupied by stop 9, and this may take place at the same time as member 3 is withdrawn or preferably, a micro-switch is used to activate the drive means of the locking member 4 when the turnstile has rotated about 10° away from its start position, so that an unauthorised reverse movement of the turnstile cannot be initiated. As stop 10 approaches the rest position, the mechanism is again activated by a micro-switch so that locking member 4 follows the stop 10 into its rest position. Similarly, as soon as the stop 9 is clear of the path of movement of the roller 7 on the locking member sleeve 5, a micro-switch comes into play, to activate the diaphragm motor by applying air pressure to the diaphragm to move the member 3 back into its locking position, in which it is latched by the balls 12. The micro-switches may be activated by pins or like means extending radially from the rear end of the turnstile shaft 2, or alternatively optically activated micro-switches (i.e. micro-switches activated by the interruption of a light beam between transmitter and receiver means), may be used.

Figure 5:
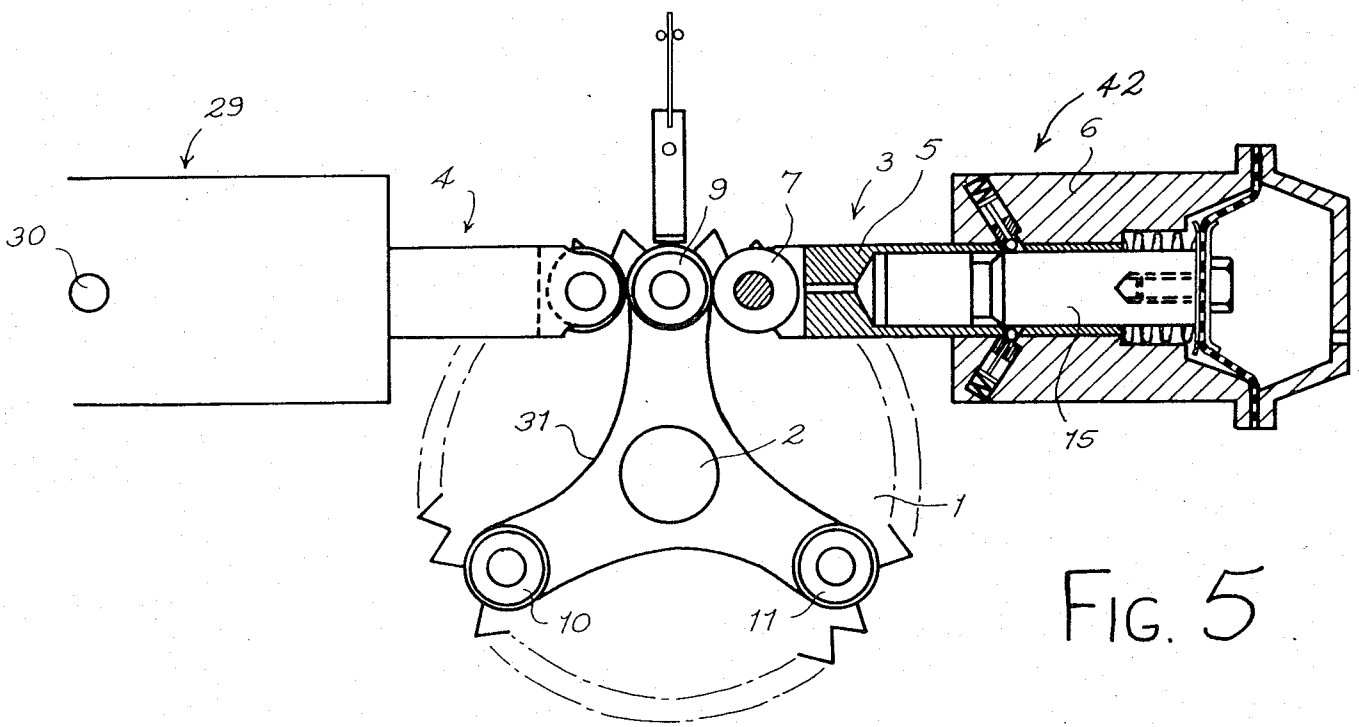
FIG. 5 is a similar view to that of FIG. 2, showing an alternative arrangement of tripod boss.

An alternative arrangement for allowing the stop 10 to pass by the locking member 4 is shown in FIG. 5. In this case the entire locking mechanism 29 comprising the locking member 4 is pivotably mounted about an axis 30, and means such as springs are provided for urging the mechanism towards a normal position in which its locking member 4 abuts the stop associated with the tripod arm currently in the blocking position. The tripod boss has a cam surface 31 extending between each pair of stops, and as the turnstile is rotated, the roller of the member 4 bears on this cam surface so that the entire mechanism is pivoted upwardly to allow the advancing stop move past it and into the rest position corresponding to the blocking position of its associated arm. Locking mechanism 42 is also similarly pivotably mounted. In both arrangements (FIG. 2 and FIG. 5), the orientation of the shaft 2 is not critical and may be horizontal, vertical or at any intermediate disposition, but where the turnstile boss shaft 2 is horizontal or substantially so, the locking mechanism in the arrangement of FIG. 5 may be urged towards its normally horizontal position by gravity, without the provision of a spring, if desired.

A ratchet mechanism is provided for preventing reverse rotation of the turnstile, once rotation has commenced in a particular direction. This mechanism is shown in FIG. 2 and consists of a plate 32, pivoted about an axis 33, and arranged so that when the turnstile is positioned with one of its arms in the blocking position, the plate 32 extends into a space or interruption 34 in a series of teeth 35 disposed in a circular array on the boss of the tripod to define a ratchet wheel. The series of teeth has interruptions in it corresponding to each of the arms, so that one of these interruptions is always positioned to receive the plate when the gate is in a locked condition. The plate is substantially elongate and is arranged so that its elongate axis extends radially of the boss in the arrangement shown. From the end of the plate opposite to that which engages in the gaps in the teeth, there extends a leaf spring 36, which is affixed to the plate at one end, and is disposed between two rollers 37 at its other end region. In operation, when the turnstile is rotated and after it has moved approximately 10° away from its starting position so that the plate has been pivoted against the action of the spring 36 up one side of the first tooth 35, the plate 32 then behaves as a pawl, being forced down into each tooth space in succession by the spring 36 as the turnstile rotates, and preventing the turnstile from being rotated in a direction opposite to that in which rotation has commenced. When the plate arrives at the next gap or interruption in the teeth, it springs back into a radially disposed position and prevents further rotation of the turnstile unless additional force is applied. Thus it also serves to index the turnstile into an orientation in which the next arm is in the blocking position, following completion of a passenger movement through the gate, since there is little or no force being exerted on the turnstile as a passenger completes his transit of the gate.

The turnstile is fully reversible and the direction in which it rotates is controlled by whichever one of the two mechanisms is initially operated to move the corresponding locking member from its locking position to its release position. In a bi-directional gate, the appropriate locking mechanism is operated depending on which side of the gate the ticket or token is inserted, or where a gate allows controlled entry but free exit, by insertion of a ticket or token on the entry side of the gate and by means such as, for example, a photoelectrically operated switch activated by user approach, on the exit side of the gate. By bringing one of the locking members to its release position and holding it there which can be accomplished simply by releasing the air pressure in the diaphragm motor, the gate will remain in a free condition for rotation of the turnstile in one direction only, provided that the other locking member is also activated for each movement through the gate in that direction. If both locking members are moved to the release position, the gate will run free in either direction. This feature is advantageous in respect of safety in that the gate is fail-safe and runs free if power is totally lost, and also allows for example, controlled entry but free exit, as required. The use of an air motor rather an electrical drive permits operation of the barrier for a limited period in the absence of any mains power, provided that an air reservoir and a low power energy source for the micro-switches are included in the installation. The provision of a simple mechanical ratcheting and indexing device eliminates a further power requirement as compared with electric solenoid means. The locking and release mechanism according to the invention thus combines mechanical simplicity with economical operation and can also be applied to a unidirectional gate construction as required, the gate including just one mechanism and a simple one-way ratchet. In busy installations, combinations of unidirectional and bidirectional gates may be advantageous.

Figure 6:
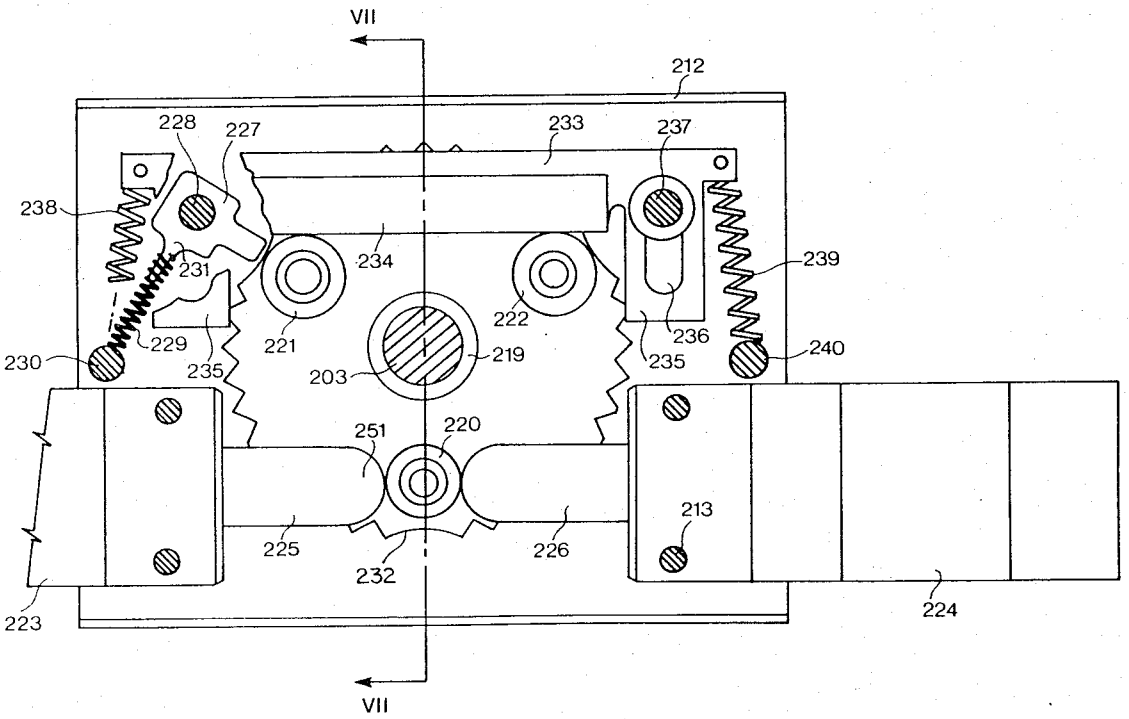
FIG. 6 is a part-sectional elevation of a further barrier locking arrangement and locking mechanism according to the invention, substantially on the line VI—VI of FIG. 7.
Figure 7:
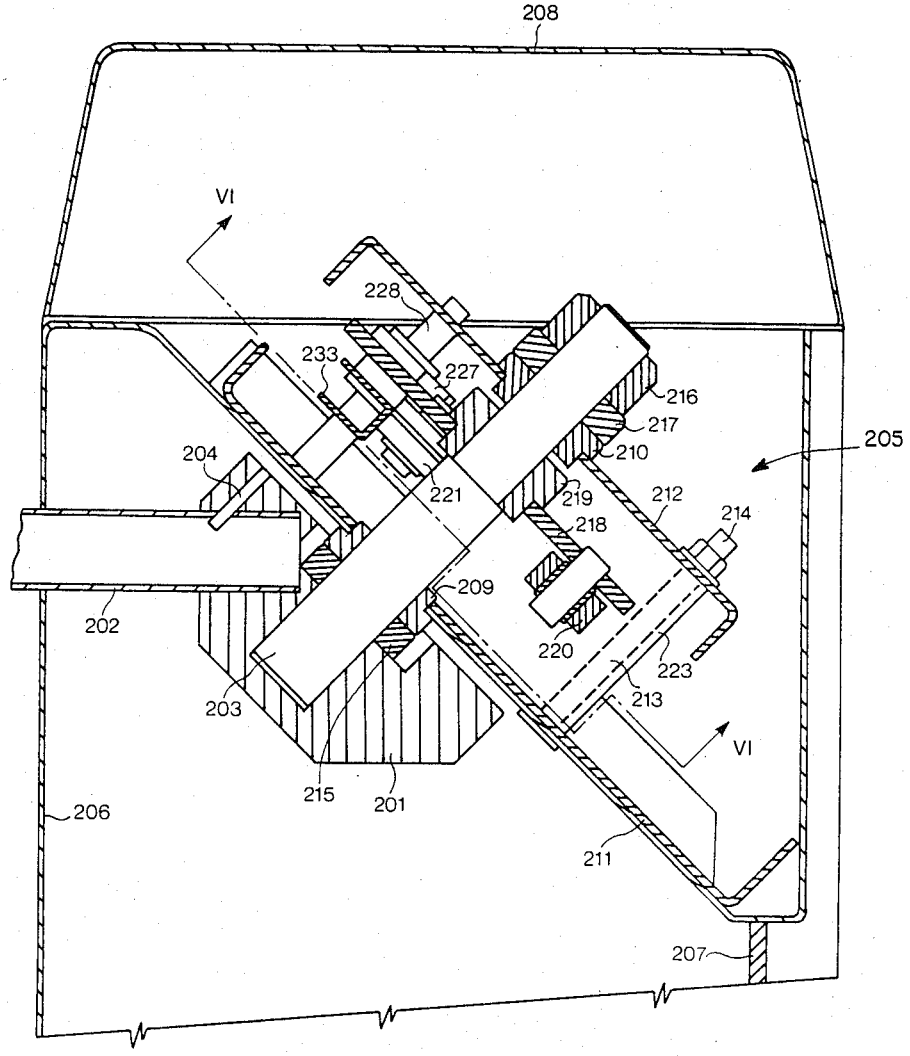
FIG. 7 is a sectional view of the arrangement of FIG. 6 on the line VII—VII of FIG. 6.

In the further arrangement shown in FIGS. 6 and 7, the tripod boss 201 carrying the turnstile arms 202 is mounted on a rotatable shaft 203, disposed at an angle similarly to the embodiment of FIG. 2, such that each arm of the turnstile, when in the blocking position, will be substantially horizontal. Each turnstile arm is secured to the turnstile boss 201 by means of a spring dowel 204. The rotatable shaft is mounted in an upper region 205 of a barrier gate structure formed from sheet metal 206 and optionally glass 207 panels mounted on a structural framework. The top of the structure is enclosed by a removable cover 208. The shaft is supported by front 209 and rear 210 bearings in a support framework formed by front 211 and a rear 212 plates secured together by bolts 213 and nuts 214. The turnstile boss is spaced from the front bearing by means of a spacer ring 215. The shaft assembly is retained in the support framework by means of a nut 216 on the rear of the shaft securing the assembly together. A microswitch tripper ring 217 is interposed between the nut 216 and the rear bearing 210 mounted in the rear plate of the support framework assembly.

A ratchet wheel 218 is fixedly mounted on the shaft 203 by means of a ratchet boss 219 for rotation with the shaft and carries three stop rollers 220, 221 and 222. Each of these rollers is associated with a particular turnstile arm and is positioned on the ratchet wheel so that the roller will occupy a rest position when its associated turnstile arm is in the horizontal blocking position in the barrier gate. Roller 220 is associated with turnstile arm 202 and as shown in the drawings, is disposed in its rest position. Opposed locking mechanisms 223 and 224 have locking members 225 and 226 abutting opposite sides of the roller 220 currently in the rest position, to lock the barrier in a blocking position. Mechanisms 223 and 224 are supported within the support framework formed by the front and rear plates by means of the bolts 213, which pass through transverse holes in the bodies of the mechanisms.

Reverse rotation of the turnstile, once a rotating movement has been initiated, is prevented by a pawl 227 rotatably mounted on a fixed shaft 228 extending between the front and rear plates of the support framework, which is biased into engagement with the ratchet wheel teeth by means of a spring 229. One end of the spring is attached to a shaft 230 extending between the front and rear plates and the other end of the spring is forced over a foot 231 extending from the pawl.

The pawl is reversible and acts for both directions of rotation of the turnstile. In the blocking configuration of the barrier, the pawl is located in a recess 232 intermediate adjacent toothed ratchet portions of the ratchet wheel.

Exact registration of the turnstile into a blocking position following completion of a passenger movement is ensured by a centralising bar 233, part of which is cut away in FIG. 6 in order to show the pawl. The centralising bar has a longitudinal central portion 234 of upwardly opening channel configuration, the base of which is arranged to bear on the two rollers 221 and 222 not currently in the rest position. At each end the centralising bar is provided with lugs 235 having elongate slots 236, the bar being guided for movement in a direction towards and away from the shaft axis by pins 228, 237 extending through the slots between the front and rear plates of the support framework. One of these pins 228 also serves as the shaft on which the pawl 227 is mounted. The centralising bar is biased by springs 238, 239 for movement towards the shaft, these springs being retained at their lower ends on pins or shafts 230, 240 extending between the front and rear plates and connected at their upper ends to the outer ends of the centralising bar. Thus the arrangement is such that any minor displacement of the blocking arm of the turnstile from its substantially horizontal orientation is resisted by the centralising bar which urges it back into this horizontal configuration.

When a passenger movement is made through the barrier, the turnstile is returned to a blocking condition either by the passenger's body or by the return axial movements of locking members 225 and 226 to their locking positions. However, slack and clearances in the mechanism may cause the turnstile arm to be spaced by a small amount from the exact blocking position and the centralising bar then acts to restore it to its horizontal orientation.

Figure 8:
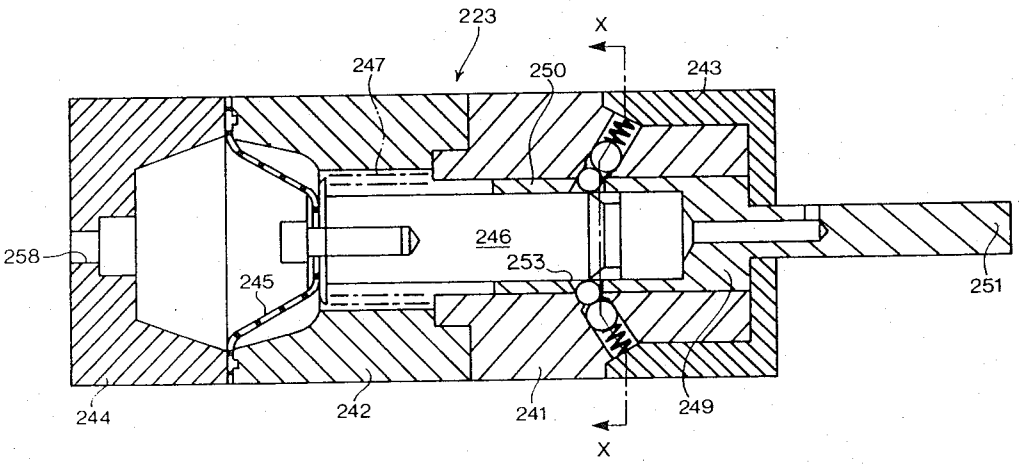
FIG. 8 is a sectional view of the locking mechanism of FIG. 6 on its longitudinal centre line.
Figure 9:
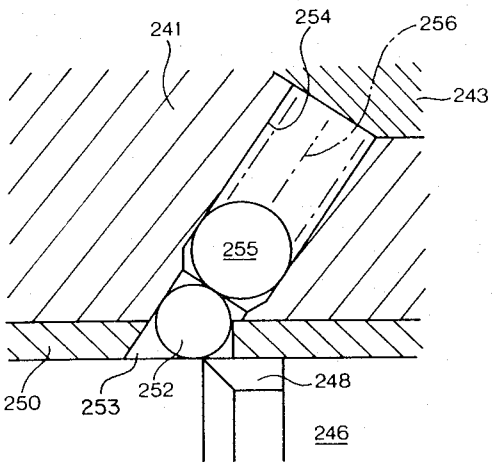
FIG. 9 is a detail view of the latch means of the mechanism of FIG. 8.

FIG. 8 shows the internal arrangement of the locking mechanism 223 or 224 while FIG. 9 shows a detail of the ball receiving recess in the cylinder body. The arrangement is substantially the same as that already described in relation to FIGS. 2, 3 and 4, the differences residing in the detailed shapes of the various elements rather than in any principle of operation. The cylinder of the mechanism consists of front 241 and rear 242 body portions with front 243 and rear 244 end caps. The diaphragm 245 is retained between the rear body portion and the rear end cap while the front end cap retains the piston assembly together as well as retaining the balls in their recesses in the front cylinder body portion.

The inner piston 246 is bolted to the diaphragm and the diaphragm is urged by a spring 274 towards a condition in which the piston assembly is withdrawn axially into the body of the mechanism. The inner piston has a circumferential groove 248 to accommodate the balls in their unlatched positions, the sloping surface of the groove being inclined at substantially 45° to the axis of the piston. The outer piston 249 forming locking member 225 has a sleeve-like portion 250 sliding over the inner piston and within the cylindrical body of the mechanism, but in this arrangement the outer piston has a rounded end 251 (see FIG. 6) which abuts directly against the roller stops. No roller is provided on the end of the piston. The end portion of the piston 249 extending from the cylinder body is of substantially rectangular cross-section and the hole in the front end cap of the cylinder, through which it extends, is of similar cross-section. Accordingly rotation of the outer piston within the cylinder body is prevented.

Figure 10:
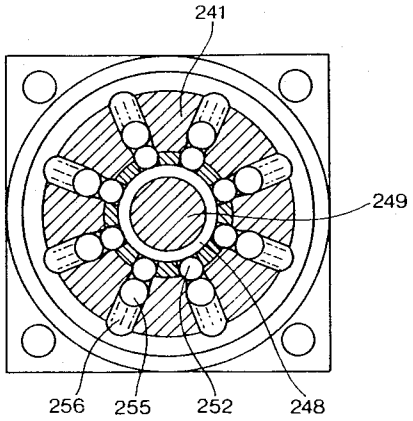
FIG. 10 is a transverse sectional view, substantially on the line 10—10 of FIG. 8.

Details of the latching balls 252 in this arrangement of the locking mechanism are shown in FIG. 9. In the locked condition of the barrier, the latching balls are in part accommodated in profiled holes 253 in the sleeve portion 250 and partly in obliquely inclined recesses 254 in the wall of the cylinder as shown in the drawing, and they are backed by further intermediate balls 255, disposed between the latching balls and the springs 256. The intermediate balls and springs can be dimensioned such that excess travel of the latching balls into the recesses in the cylinder wall may be prevented. At their ends adjoining the cylinder bore, the recesses 254 in the cylinder body are shaped so that the intermediate balls can push the latching balls into engagement with the groove in the inner piston but are prevented from advancing sufficiently from the recesses to interfere with movement of the outer piston. Eight sets of balls are provided (see FIG. 10) and the latching arrangement is assembled from the outer ends of the recesses in the cylinder body when the end cap is removed. The circumferential array of latching and intermediate balls is shown in the sectional view of FIG. 10.

Operation of the arrangement of FIGS. 6–10 is similar to that already described. Air pressure is applied through aperture 258 to the diaphragm 246 in order to maintain the barrier in a locked condition, and is released to allow the spring to withdraw the locking member 225 axially from its abutting position against the roller 220. The locking member 226 abutting the other side of the roller may be released at the same time or following initiation of turnstile rotation. The micro-switch tripper 217 carries three pins spaced at 120° and located relative to the turnstile arms so that two of the pins trip respective micro-switches controlling the re-application of pressurised air to the diaphragms of the locking mechanisms, shortly before a 120° rotation of the turnstile is completed. Thus both front and rear locking mechanisms move back against the next roller arriving in the rest position corresponding to the blocking configuration of the turnstile as the passenger completes his passage of the gate and moves forward from the turnstile. The locking mechanisms hold the roller in the rest position and exact registration of the barrier means in the blocking position is brought about by the centralising bar. Control of the application of air pressure to the diaphragms of the locking mechanisms and release of the air pressure from them is achieved by means of an air valve or valves, activated by presentation of a valid ticket or by manual means. The barrier may be operated in either direction, and ticket control mechanisms may be associated with it for each direction of movement. Alternatively the barrier may respond to the presentation of tickets for movement only, in one direction, and photocell means may be associated with the gate to detect the presence of a passenger wishing to pass through in the opposite direction and unlock the locking mechanisms. Thus the barrier may provide for controlled entry but free exit in for example a railway station.

I claim:

1. A locking and release mechanism for a barrier of a gate having at least one stop member associated with the barrier, said mechanism comprising:

(a) a body portion of the mechanism having a fixed latch-abutment portion, (b) a locking member having a movable latch-abutment portion and being displaceable relative to said body portion between a locking position in which the locking member engages the stop member to prevent displacement of the barrier and a release position in which the barrier may be displaced, (c) latch means for retaining the locking member in its locking position, the latch means having a latch member displaceable between a latching position in which it engages between said fixed and movable latch-abutment portions and an unlatched position in which it is disengaged from said fixed abutment portion, said abutment portions being disposed relative to the latch member in its latching position so that when the locking member is in its locking position and a force is applied to it urging it towards its release position, said abutment portions apply forces to the latch member urging it towards its unlatched position, and (d) latch holding and release means having a latch release member displaceable between a latch retaining position in which it maintains the latch member in its latching position and a releasing position in which the latch member may be displaced from its latching position towards its unlatched position.

2. A locking and release mechanism according to claim 1, wherein the latch release member has a surface portion for maintaining the latch member in its latching position and a portion which is recessed relative to said surface portion, for receiving the latch member in its unlatched position.

3. A locking and release mechanism according to claim 2, wherein the recessed portion has a cam surface for displacing the latch member from its unlatched position towards its latching position when the latch release member is moved from its releasing position towards its retaining position.

4. A locking and release mechanism according to claim 3, wherein the latch member in its unlatched position couples the locking member and latch release member for displacement together.

5. A locking and release mechanism according to claim 4, wherein the locking member has a coupling abutment portion and the latch release member has a coupling abutment surface, the latch release member is further displaceable between its releasing position and an end position, and the latch member engages between the latch-abutment and coupling abutment portions of the locking member and between the cam surface and coupling abutment surface of the latch release member in the released condition of the latch means and is retained therebetween during movement of the latch release member between its releasing position and its end position.

6. A locking and release mechanism for a barrier of a gate having at least one stop member associated with the barrier, said mechanism comprising:

(a) a body portion of the mechanism having a fixed latch-abutment portion, (b) a locking member having a movable latch-abutment portion and being displaceable relative to said body portion between a locking position in which the locking member engages the stop member to prevent displacement of the barrier and a release position in which the barrier may be displaced, (c) latch means for retaining the locking member in its locking position, the latch means having a latch member displaceable between a latching position in which it engages between said fixed and movable latch-abutment portions and an unlatched position in which it is disengaged from said fixed abutment portion, said abutment portions being disposed relative to the latch member in its latching position so that when the locking member is in its locking position and a force is applied to it urging it towards its release position, said abutment portions apply forces to the latch member urging it towards its unlatched position, the latch-abutment portions each comprising a surface which contacts the latch member, at least when the latch member is in its latching position and when a force is applied to the locking member to urge it towards its release position, and the latch member being of circular cross-section, its periphery being tangent to said surfaces and said surfaces being non-parallel, at least in those regions tangent to the latch member, and (d) latch holding and release means having a latch release member displaceable between a latch retaining position in which it maintains the latch member in its latching position and a releasing position in which the latch member may be displaced from its latching position towards its unlatched position, the latch release member having a surface portion for maintaining the latch member in its latching position and a portion which is recessed relative to said surface portion, for receiving the latch member in its unlatched position, the recessed portion having a cam surface for displacing the latch member from its unlatched position towards its latching position when the latch release member is moved from its releasing position towards its retaining position, the latch member in its unlatched position coupling the locking member and latch release member for displacement together, the locking member having a coupling abutment portion and the latch release member having a coupling abutment surface, the latch release member being further displaceable between its releasing position and an end position, and the latch member engaging between the latch-abutment and coupling abutment portions of the locking member and between the cam surface and coupling abutment surface of the latch release member in the released condition of the latch means and being retained therebetween during movement of the latch release member between its releasing position and its end position.

7. A locking and release mechanism according to claim 6, wherein:

(a) said body portion of the mechanism has a cylinder, said cylinder having a plurality of substantially cylindrical recesses in the cylinder wall, the axis of each recess being disposed at an acute angle relative to the cylinder axis, and the body portion has a plurality of said fixed latch-abutment portions, each defined by a wall portion of a said recess.

(b) said locking member is an sleeve-form outer piston, which is axially displaceable within said cylinder and has a plurality of circumferentially spaced skewed conical holes therein corresponding in number to the number of said recesses, and the locking member has a plurality of said latch-abutment portions and said coupling abutment portions defined by respective opposed wall portions of said holes, (c) said latch means has a plurality of latch members, each of which is a ball, and springs are provided in said recesses in the cylinder wall for urging the balls outwardly thereof when in their latching positions, (d) said latch release member is an inner piston, which is axially displaceable within said sleeve-form outer piston between its retaining and end positions and is coupled to said outer piston during movement between its releasing and end positions, said recessed portion is an annular groove and said cam surface and coupling abutment surface are defined by side walls of said groove, and (e) the latch holding and release means comprises means for driving the latch release member between its retaining and releasing position and for driving it between its releasing position and its end position to move the locking member between its locking and release positions.

8. A locking and release mechanism according to claim 7, wherein said driving means is an air motor.

9. A locking and release mechanism according to claim 8, wherein said air motor has a diaphragm and a spring for urging the inner piston from its releasing position towards its end position, the diaphragm being displaceable by air pressure to move the inner piston from its end position towards its releasing position against the force of the spring.

10. A locking and release mechanism for a barrier of a gate having at least one stop member associated with the barrier, said mechanism comprising:

(a) a body portion of the mechanism having a cylinder, said cylinder having a plurality of substantially cylindrical recesses in the cylinder wall, the axis of each recess being disposed at an acute angle relative to the cylinder axis, and a wall portion of each said recess defining a fixed latch-abutment portion, (b) an outer sleeve-form locking piston, which is axially displaceable within said cylinder between a locking position in which said piston engages the stop member to pevent displacement of the barrier and a release position in which the barrier may be displaced, the piston having a plurality of circumferentially spaced skewed conical holes therein corresponding in number to the number of said recesses, (c) a plurality of latching balls, displaceable between latching positions in which they engage between wall portions of said outer piston holes and fixed latch-abutment portions and unlatched positions in which they are disengaged from said fixed latch-abutment portions, springs being provided in said recesses for urging the balls outwardly thereof when in their latching positions, (d) an inner latch release piston which is axially displaceable within said outer piston between a latch retaining position and a releasing position and between said releasing position and an end position, said release piston having a surface portion for maintaining the balls in their latching positions when the piston is in its retaining position and an annular groove for receiving the balls in their unlatched positions, the latching balls being accommodated partially in said outer piston holes and partially in said inner piston annular groove during movement of the inner piston between its releasing and end positions to couple the pistons together, and a side wall of said groove defining a cam surface for displacing the latching balls from their unlatched positions to their latching positions during movement of the inner piston from its releasing position to its retaining position, and (e) means for driving the inner piston between its retaining and releasing positions and between its releasing and end positions.

11. A gate having at least one barrier, a stop member associated with the or each barrier and at least one locking mechanism according to claim 10.

12. A gate according to claim 11, having a plurality of barriers, each consisting of an arm of a turnstile of the tripod type, in which three arms extend from a rotatably mounted boss, the boss being mounted so that one arm is substantially horizontally disposed in a blocking position at least when the gate is in a locked condition and each of the other arms is then disposed in a clear position, the locking member then abutting the stop member associated with the substantially horizontally disposed arm and being moved to its release position to permit rotation of the turnstile and displacement of the initially substantially horizontal arm to one of said clear positions.

13. A gate according to claim 12, wherein the gate has a rotatable ratchet member forming part of or operatively associated with the turnstile and a spring-loaded pawl member, the rotatable member being provided with a series of spaced apart teeth disposed along a circular path about the axis of rotation of the rotatable member, said series having three spaced apart interruptions and said pawl member being disposed in a said interruption in the series of teeth when the barrier is in its blocking position.

14. A gate according to claim 13, having two locking and release mechanisms, each locking member abutting an opposite side of the stop member in the locked condition of the gate, and the other of said locking members being displaceable during a said rotation of the turnstile to permit displacement of the arm initially disposed in the other of said clear positions into a substantially horizontal disposition in which said arm is disposed in a blocking position.

15. A gate according to claim 14, wherein the ratchet member is bidirectional for preventing reverse displacement of the barrier during displacement thereof from its blocking position to a clear position, at least until it reaches said clear position.

16. A gate according to claim 15 having switch means for reversing the movement of the first-mentioned locking member so that it moves from its release position to its locking position during a said rotation to prevent displacement of the arm undergoing displacement towards said blocking position of the barrier beyond said blocking position by abutment of the stop member associated with said arm against said locking member.

17. A locking and release mechanism comprising at least one locking member movable between a locking position and a release position and at least one stop member displaceable between a rest position and a free position along at least one path, displacement of the stop member from its rest position at least along said path being prevented when the locking member is in its locking position, the stop member being displaceable at least along said path at least when the locking member is in its release position and movement of the locking member from its locking position towards its release position permitting displacement of the stop member from its rest position towards said free position along said path, releasable latch means for retaining the locking member in its locking position having at least one latch member displaceable between a latching position and an unlatched position, and latch holding and release means for maintaining the latch member in its latching position and operable to release said latch means and permit displacement of the latch member from its latching position towards its unlatched position, the locking member being movable between its locking position and its release position when the latch means is in a released condition, the latch member being interposed between an abutment portion of the locking member and a fixed abutment of the mechanism when in its latching position to prevent movement of the locking member from its locking position towards its release position, and said abutment portion and fixed abutment being disposed relative to the latch member in its latching position so that when the locking member is in its locking position and a force is applied to it urging the locking member towards its release position, said abutment portion and fixed abutment apply forces to the latch member urging it towards its unlatched position, the latch member being maintained in its latching position by said latch holding and release means until the latch holding and release means is operated to release the latch means.

18. A gate having means defining a passage for movement through the gate and at least one barrier means which is disposed in a blocking position at least whe the gate is in a locked condition and is displaceable at least from its blocking position to a clear position when the gate is in a free condition, movement through the passage being substantially inhibited when the gate is in its locked condition and being substantially unhindered by the barrier means when the gate is in its free condition, at least during displacement of the barrier means from its blocking position to said clear position, said gate having at least one locking and release mechanism according to claim 17.

* * * * *